US011472050B2

(12) United States Patent
Bridges et al.

(10) Patent No.: US 11,472,050 B2
(45) Date of Patent: Oct. 18, 2022

(54) BOTTLE FOR A PERSONAL CARE DEVICE

(71) Applicant: The Gillette Company LLC, Boston, MA (US)

(72) Inventors: Kelly Daniel Bridges, Boston, MA (US); Christopher Ramm, Boston, MA (US); Ted DeCastro, Boston, MA (US); Philipp Goeder, Frankfurt (DE)

(73) Assignee: The Gillette Company LLC, Boston, MA (US)

( * ) Notice: Subject to any disclaimer, the term of this patent is extended or adjusted under 35 U.S.C. 154(b) by 37 days.

(21) Appl. No.: 16/788,747

(22) Filed: Feb. 12, 2020

(65) Prior Publication Data

US 2020/0254639 A1 Aug. 13, 2020

Related U.S. Application Data

(60) Provisional application No. 62/804,418, filed on Feb. 12, 2019.

(51) Int. Cl.

| | |
|---|---|
| ***B26B 21/44*** | (2006.01) |
| ***B65D 83/00*** | (2006.01) |
| *B26B 21/06* | (2006.01) |
| *B26B 21/22* | (2006.01) |
| *B26B 21/40* | (2006.01) |
| *B26B 21/52* | (2006.01) |

(52) U.S. Cl.

CPC ..... *B26B 21/446* (2013.01); *B65D 83/0055* (2013.01); *B26B 21/06* (2013.01); *B26B 21/22* (2013.01); *B26B 21/4018* (2013.01); *B26B 21/4025* (2013.01); *B26B 21/528* (2013.01)

(58) Field of Classification Search

CPC ..... B26B 21/44; B26B 21/446; B26B 21/06; B26B 21/22; B26B 21/4018; B26B 21/4025; B26B 21/528; B65D 83/0055

USPC ..... 30/32, 41, 537, 538, 526, 535

See application file for complete search history.

(56) References Cited

U.S. PATENT DOCUMENTS

| | | | | |
|---|---|---|---|---|
| 514,426 | A | 2/1894 | Outerbridge, Jr. | |
| D176,728 | S | 1/1956 | Nolan | |
| 2,747,273 | A | 5/1956 | Olsson | |
| 2,803,028 | A | 8/1957 | Charles | |
| D191,685 | S | 10/1961 | Price | |
| D223,438 | S | 4/1972 | Lluch | |
| D228,343 | S | 9/1973 | Kretz | |
| D238,930 | S | 2/1976 | Dadmun | |
| D268,988 | S | 5/1983 | Hirsh | |
| D285,655 | S | 9/1986 | MacLaughlin et al. | |
| 5,016,351 | A * | 5/1991 | Drahus | B26B 21/446 30/41 |
| D330,859 | S | 11/1992 | Schaeffer | |

(Continued)

OTHER PUBLICATIONS

All Office Actions, U.S. Appl. No. 29/650,040.

(Continued)

*Primary Examiner* — Phong H Nguyen
(74) *Attorney, Agent, or Firm* — John M. Lipchitz

(57) ABSTRACT

A personal care bottle with a distal end portion and a proximal end with a shoulder. A collapsible bag is positioned within the bottle. The collapsible bag configured to contain a liquid. A cap defining an opening having a frangible seal is cap mounted to the proximal end. The bottle has an outer surface defining a groove extending from the shoulder toward the distal end portion.

4 Claims, 9 Drawing Sheets

(56) References Cited

U.S. PATENT DOCUMENTS

| | | | |
|---|---|---|---|
| D332,050 | S | 12/1992 | Schmidt |
| D357,628 | S | 4/1995 | Vasas |
| D398,002 | S | 9/1998 | Stewart et al. |
| D401,856 | S | 12/1998 | Daniels |
| 5,855,066 | A | 1/1999 | Manger |
| D417,034 | S | 11/1999 | Shurtleff |
| D421,966 | S | 3/2000 | Allen et al. |
| D429,034 | S | 8/2000 | Shurtleff |
| D437,661 | S | 2/2001 | Pinchuk |
| D464,329 | S | 10/2002 | Mainiero |
| D469,356 | S | 1/2003 | Vo |
| D474,478 | S | 5/2003 | Laverick et al. |
| D475,159 | S | 5/2003 | Fisher |
| D489,984 | S | 5/2004 | Futral et al. |
| D539,154 | S | 3/2007 | Beach-drummond |
| D549,671 | S | 8/2007 | Teiber et al. |
| D561,035 | S | 2/2008 | Leslie et al. |
| D576,040 | S | 9/2008 | Martins, Jr. |
| D592,060 | S | 5/2009 | Chupak |
| D594,339 | S | 6/2009 | Geeraert et al. |
| D596,037 | S | 7/2009 | Slubski |
| D602,369 | S | 10/2009 | Potts et al. |
| D606,407 | S | 12/2009 | Fadelli |
| D611,818 | S | 3/2010 | Monin |
| D614,492 | S | 4/2010 | Hermel |
| D615,404 | S | 5/2010 | Pitzer et al. |
| D624,243 | S | 9/2010 | Rhoad |
| D644,532 | S | 9/2011 | Hodges et al. |
| D651,515 | S | 1/2012 | Haile |
| D652,723 | S | 1/2012 | Reisig |
| D652,991 | S | 1/2012 | Cavazos et al. |
| D654,221 | S | 2/2012 | Christie et al. |
| D654,794 | S | 2/2012 | Morais et al. |
| D655,172 | S | 3/2012 | Brooks et al. |
| D656,676 | S | 3/2012 | Cavazos et al. |
| D656,677 | S | 3/2012 | Cavazos et al. |
| D660,516 | S | 5/2012 | Christie et al. |
| D661,594 | S | 6/2012 | Renieris |
| D663,623 | S | 7/2012 | Slubski |
| D680,436 | S | 4/2013 | Sanchez |
| D680,437 | S | 4/2013 | Bartolo et al. |
| D682,703 | S | 5/2013 | Martin |
| D684,060 | S | 6/2013 | Hodges |
| D691,885 | S | 10/2013 | Potts |
| D694,627 | S | 12/2013 | Sultan |
| D695,121 | S | 12/2013 | Seo |
| D699,395 | S | 2/2014 | Bae |
| D707,128 | S | 6/2014 | Fedewa et al. |
| D710,056 | S | 7/2014 | Martin |
| D712,026 | S | 8/2014 | Cant et al. |
| D714,644 | S | 10/2014 | Wagner et al. |
| D715,150 | S | 10/2014 | Fedewa et al. |
| D719,446 | S | 12/2014 | Ponomarenko |
| D730,189 | S | 5/2015 | Haile |
| D736,644 | S | 8/2015 | Hamilton |
| D740,676 | S | 10/2015 | Brown et al. |
| D740,681 | S | 10/2015 | Hamilton |
| D746,140 | S | 12/2015 | Watabe |
| D751,932 | S | 3/2016 | Chong et al. |
| D757,364 | S | 5/2016 | Aulwes et al. |
| D764,971 | S | 8/2016 | Schulz et al. |
| D787,333 | S | 5/2017 | Ma |
| D805,904 | S | 12/2017 | Kim |
| D811,881 | S | 3/2018 | Lauret |
| D828,310 | S | 9/2018 | Luke et al. |
| D829,468 | S | 10/2018 | Anderson et al. |
| D829,993 | S | 10/2018 | Hage et al. |
| D830,826 | S | 10/2018 | Bae |
| D843,658 | S | 3/2019 | Kong |
| D874,941 | S | 2/2020 | Wittek et al. |
| D883,784 | S | 5/2020 | Laib et al. |
| D887,641 | S | 6/2020 | Ramm et al. |
| D894,598 | S | 9/2020 | Applegate et al. |
| 10,800,058 | B2 * | 10/2020 | Eagleton ..... B26B 21/522 |
| D909,136 | S | 2/2021 | Hannouche |
| D911,606 | S | 2/2021 | Ramm et al. |
| D918,051 | S | 5/2021 | Sanghavi |
| D937,681 | S | 12/2021 | Ramm et al. |
| 2008/0209733 | A1 | 9/2008 | Johnson |
| 2009/0134111 | A1 | 5/2009 | Schroeder |
| 2009/0320293 | A1 | 12/2009 | Clarke |
| 2010/0107415 | A1 | 5/2010 | Kurzet |
| 2012/0102742 | A1 | 5/2012 | Jessemey |
| 2012/0102761 | A1 | 5/2012 | Jessemey et al. |
| 2013/0145625 | A1 | 6/2013 | Xu |
| 2013/0145626 | A1 | 6/2013 | Xu |
| 2014/0183226 | A1 * | 7/2014 | Fily ..... B65D 25/20 222/143 |
| 2015/0013166 | A1 * | 1/2015 | Burrowes ..... B26B 21/528 30/41 |
| 2015/0121704 | A1 | 5/2015 | Bridges et al. |
| 2015/0121705 | A1 | 5/2015 | Coffindaffer et al. |
| 2017/0266827 | A1 * | 9/2017 | Moretti ..... B26B 21/522 |
| 2018/0200899 | A1 | 7/2018 | Eagleton |
| 2018/0297225 | A1 | 10/2018 | Hodgson |
| 2019/0299466 | A1 | 10/2019 | Goeder et al. |
| 2019/0299471 | A1 | 10/2019 | Verasamy et al. |
| 2019/0299472 | A1 | 10/2019 | Johnson et al. |
| 2019/0365078 | A1 | 12/2019 | Bourque |
| 2019/0365079 | A1 | 12/2019 | Bourque |
| 2020/0114381 | A1 | 4/2020 | Bhandari |

OTHER PUBLICATIONS

All Office Actions, U.S. Appl. No. 29/650,044.
All Office Actions. U.S. Appl. No. 29/679,988.
All Office Actions, U.S. Appl. No. 29/734,437.
International Search Report, PCT/US2020/017843 dated Jun. 5, 2020, 12 pages.

* cited by examiner

BOTTLE FOR A PERSONAL CARE DEVICE

FIELD OF THE INVENTION

The present invention relates to bottles for personal care devices and more particularly to, bottles for liquid dispensing razors.

BACKGROUND OF THE INVENTION

Skin care can be of particular importance in improving or enhancing the appearance of men and women. Various products and methods can be used to care for skin. For example, exfoliant scrubs, cleansers, and lotions are sometimes used to maintain healthy-looking skin. Exfoliant scrubs can be used to remove dead skin cells from the surface of the skin, which can give the skin an improved tone. Soaps and other cleansers can be used to remove dirt and excess oil from the skin, which can help prevent clogging of pores. Consequently, acne and other types of skin blemishes can be prevented in some cases. Lotions and various other topical ointments can also be used to deliver nutrients and/or moisturizers to the skin in an effort to improve the appearance and/or the health of the skin. Other types of cosmetic products (e.g., creams and lotions) or drug actives are sometimes used in an attempt to eliminate wrinkling and other signs of aging.

It is generally known that the process of shaving the skin may provide certain skin benefits such as exfoliation and hydration. In general, shaving razors of the wet shave type include a cartridge or blade unit with at least one blade with a cutting edge which is moved across the surface of the skin being shaved by means of a handle to which the cartridge is attached; however, razor assemblies may also include electric foil type shavers. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled (i.e., disposable razor). The connection of the cartridge to the handle provides a pivotal mounting of the cartridge with respect to the handle so that the cartridge angle adjusts to follow the contours of the surface being shaved. In such systems, the cartridge can be biased toward a rest position by the action of a spring-biased plunger (a cam follower) carried on the handle against a cam surface on the cartridge housing.

The shaving process typically includes the application of a shaving aid material (e.g., shaving cream) to the surface and the separate step of shaving the hair using a razor assembly. The shaving aid material often times includes at least one suitable agent (e.g., a lubricating agent, a drag-reducing agent, a depilatory agent, etc.) that enhances the shaving process. Most consumers find this type of preparation to be rather inconvenient because of the need for multiple shaving products, e.g., a wet shaving razor and a skin preparation product, as well as the undesirable necessity for multiple application steps during the wet shaving process. Furthermore, this process can be messy and requires the consumer rinse their hands after applying the shave gel. This multi-step process also results in an overall extended shaving experience which most consumers do not prefer given typical morning hygiene routines. It may, however, be desirable sometimes to apply liquids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave.

In the past, there have been a number of wet shaving product configurations that include a system for conveying a shaving preparation during shaving, e.g. a lubricating liquid, from a reservoir incorporated in the razor structure in the form of a hollowed-out razor handle or even an aerosol can that acts as a razor handle, to a dispensing location near the head of the razor. A number of more recent wet shaving razors have cartridges that are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. Many of these types of razors that are capable of conveying a liquid to the skin surface are unfortunately plagued by a number of problems. For instance, the bottles often lack functionality other than storing and transferring a liquid. Accordingly, the functionality, such as securing the bottle in place properly must be provided by the handle, which may not be intuitive. Furthermore, a delaminating bag inside a bottle is often used for delivering a liquid in association with a pump, but these designs are also limited because of the current manufacturing processes. Accordingly, it is difficult to incorporate various design features into the bottle.

SUMMARY OF THE INVENTION

In one aspect, the invention features, in general a personal care bottle with a distal end portion and a proximal end with a shoulder. A collapsible bag is positioned within the bottle. The collapsible bag configured to contain a liquid. A cap having a centerline and defining an opening having a frangible seal is cap mounted to the proximal end. The bottle has an outer surface defining a groove extending from the shoulder toward the distal end portion.

In another aspect, the invention features, in general a personal care bottle with a proximal end having a shoulder. A collapsible bag is positioned within the personal care bottle. The collapsible bag is configured to contain a liquid. A cap is mounted to the proximal end of the bottle. The cap has a centerline and defines an opening having a frangible seal. A horizontal distance from the centerline to a first outer surface where the personal care bottle meets the cap is less than a horizontal distance from the centerline to a second outer surface of the personal care bottle where the personal care bottle meets the cap.

In another aspect, the invention features, in general a personal care bottle with a proximal end with a shoulder. A collapsible bag positioned within the personal care bottle. The collapsible bag is configured to contain a liquid. A cap is mounted to the proximal end of the bottle. The cap has a centerline and defines an opening having a frangible seal. A horizontal distance from the centerline to a first outer surface where the personal care bottle meets the cap is less than a horizontal distance from the centerline to a second outer surface of the personal care bottle where the personal care bottle meets the cap.

In another aspect, the invention features, in general a shaving razor system having a bottle having a proximal end with a shoulder, a distal end portion and defining a groove extending from the shoulder toward the distal end portion. A sealed collapsible bag is positioned within the bottle. The bag is configured to contain a liquid. A cap is mounted to the proximal end of the bottle. The cap defines an opening having a frangible seal. The cap has an outer wall that is generally aligned with a bottom surface of the groove. A handle having an opening at a first end is dimensioned to receive the bottle. The handle has a protrusion positioned within the groove of the bottle.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
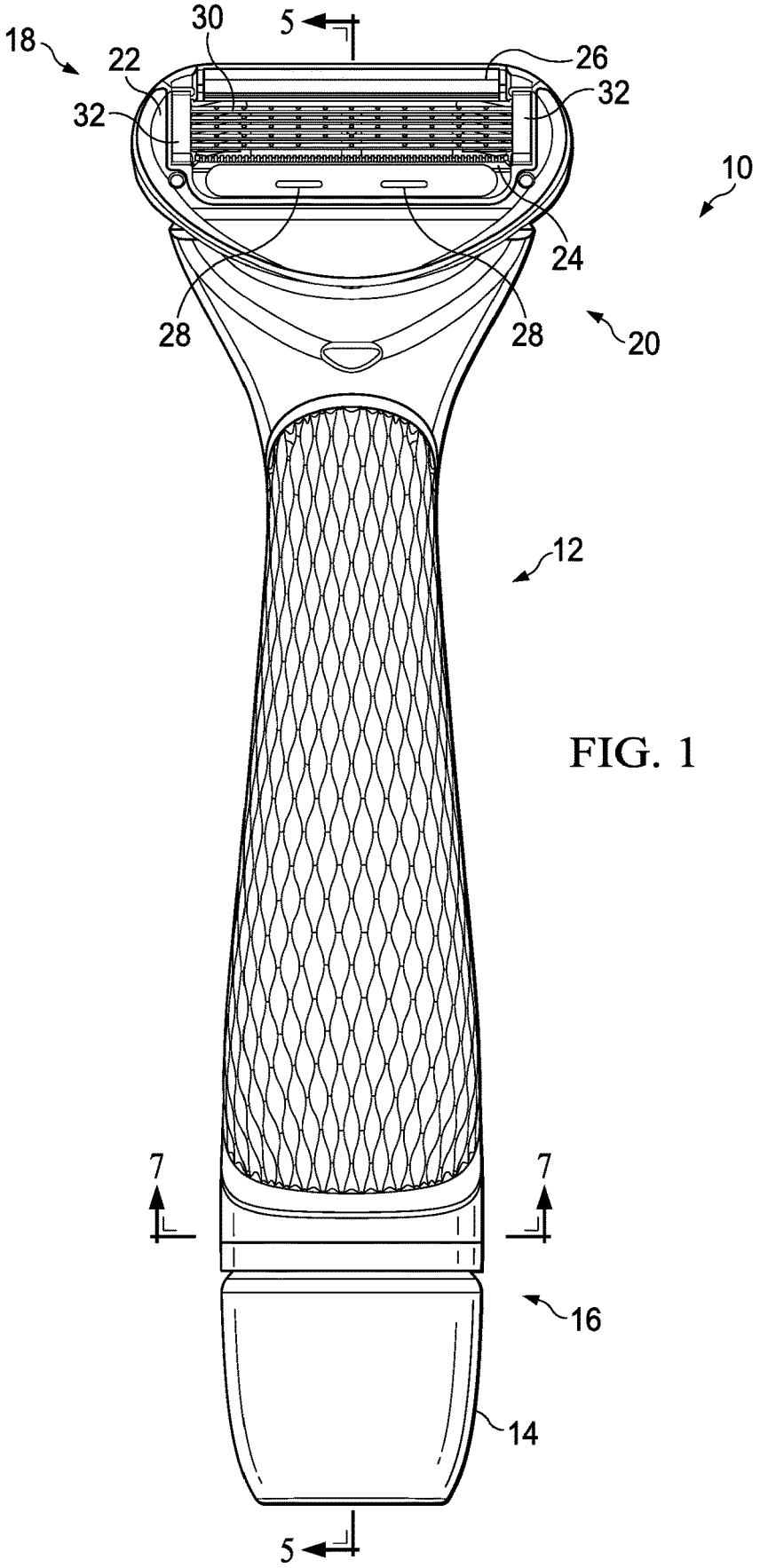
FIG. 1 is a front view of a liquid dispensing shaving razor.

Referring to FIG. 1, a perspective view of a shaving razor system 10 is shown. The shaving razor system 10 may include handle 12 with a personal care bottle 14 mounted to a first end 16 of the handle 12 and a shaving razor cartridge 18 mounted to an opposing second end 20 of the handle 12. The shaving razor cartridge 18 may be removable or permanently mounted to the handle 12. For example, the shaving razor cartridge 18 may be detachably mounted to the handle 12 to enable the shaving razor cartridge 18 to be replaced by a fresh shaving razor cartridge 18 when blade sharpness has diminished to an unsatisfactory level. Alternatively, the shaving razor cartridge 18 may be attached permanently to the handle 12 with the intention that the entire shaving razor system 10 be discarded when the blade or blades have become dulled. The shaving razor cartridge 18 may include a housing 22. The housing 22 may be injection molded from a first polymeric material. The housing 16 may be molded from polymers such as high impact polystyrene (HIPS), but other semi-rigid polymers such as polypropylene (PP), nylon, acrylonitrile butadiene styrene (ABS), polyphenylene ether, polystyrene, and combinations thereof may also be used.

A guard 24 may be positioned toward a front of the housing 22 and a cap 26 may be positioned at a rear portion of the housing 22. The guard 24 may be a unitary elongated member that can be formed of a rigid plastic (e.g., the same material as the housing 22). For example, the guard 24 may be a solid or segmented bar that extends generally parallel to the cap 26 to help support the skin during a shaving stroke. In certain embodiments, the cap 26 may comprise one or more lubricants that are released during shaving. The shaving razor system 10, for example, the housing 22, may have one or more openings 28 to dispense a fluid contained in the personal care bottle 14. In certain embodiments, the openings 28 may be positioned in front of the guard 24.

The guard 24 and the cap 26 may define a shaving plane that is tangent to the guard 24 and the cap 26. One or more blade members 30 each having a respective cutting edge may be mounted to the housing 22 between the cap 26 and the guard 24 (i.e., in front of the cap 26 behind the guard 24). Although five blade members 30 are shown, the shaving razor cartridge 18 may have more or fewer blade members 30 depending on the desired performance and cost of the shaving razor cartridge 18. The blade members 30 may be secured to the housing 18 with one or more blade retention members 32, such as clips.

Figure 2:
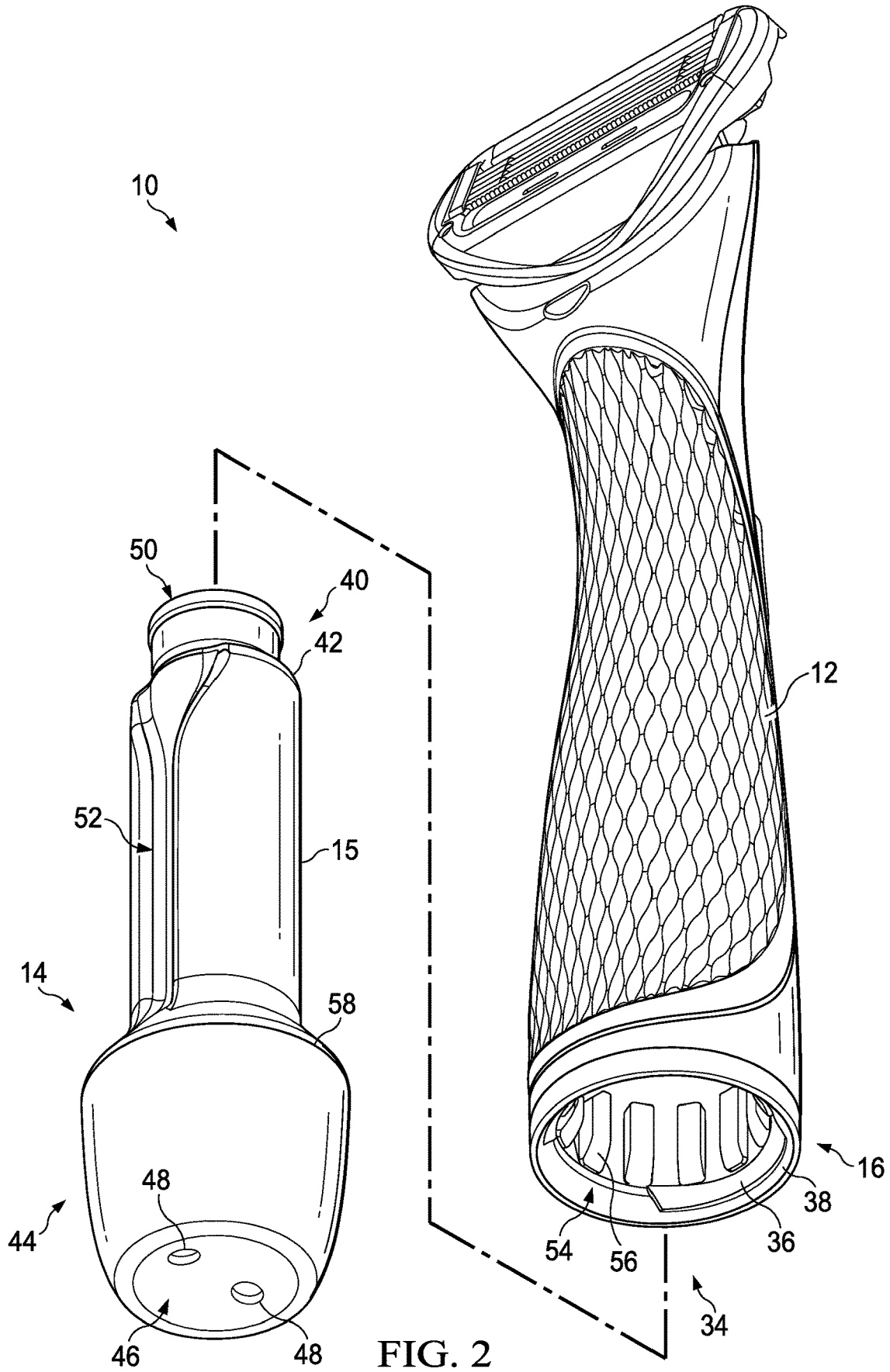
FIG. 2 is an assembly view of the liquid dispensing shaving razor of FIG. 1.

Referring to FIG. 2, an assembly view of the shaving razor system 10 is shown. The first end 16 of the handle 12 may define an opening 34 configured to receive the personal care bottle 14. The first end 16 may have a partially enclosed rim 36 (e.g., positioned on an inner surface 38 of the handle 12) configured to facilitate proper alignment of the personal care bottle 14. The personal care bottle 14 may have a proximal end 40 with a shoulder 42 and a distal end portion 44. The distal end portion 44 (e.g., bottom surface 46) may have one or more vent openings 48 to release air from within the personal care bottle 14 (e.g., between the inner delaminating bag (not shown) and an inner surface (not shown) of the personal care bottle 14. A cap 50 may be mounted to the proximal end 40 of the personal care bottle 14 (e.g., on the shoulder 42). The personal care bottle 14 may have an outer surface 15 defining a groove 52 extending from the shoulder 42 toward the distal end portion 44. The groove 52 may have a width that is greater toward the shoulder 42 than a width of the groove 52 toward the distal end portion 44 to facilitate insertion and alignment of the personal care bottle 14 into the opening 34 of the handle 12. The width of the groove 52 toward the shoulder 42 may be about 4.5 mm to 9 mm and the width of the groove toward the distal end portion 44 may be about 2 mm to about 4 mm.

As will be explained in greater detail below, the groove 52 may facilitate proper alignment of the personal care bottle 14 and prevent rotation of the personal care bottle within the handle 12. The partially enclosed rim 36 may define a gap 54 that is generally aligned with one or more protrusions 56 (e.g., ribs) on the inner surface 38 of the handle 12. The groove 52 of the personal care bottle 14 may be dimensioned to receive the protrusion 56. The partially enclosed rim 36 may prevent the personal care bottle 14 from being inserted into the handle 12 in the wrong orientation. A consumer may align the gap 54 with an enlarged end of the groove 52 (i.e., located at the shoulder 42), which facilitates aligning the groove 52 with the protrusion 56. The distal end portion 44 may have a shoulder 58 that the rim 36 mounts to. Accordingly, the rim 36 may contact the shoulder 58 to prevent the personal care bottle 14 from being inserted too far into the handle 12. A more aesthetically pleasing design may also be provided by having a stop surface (e.g., the rim 36) on the inner surface 38, such that at least a portion of the shoulder 58 is positioned within the handle 12.

Figure 3A:
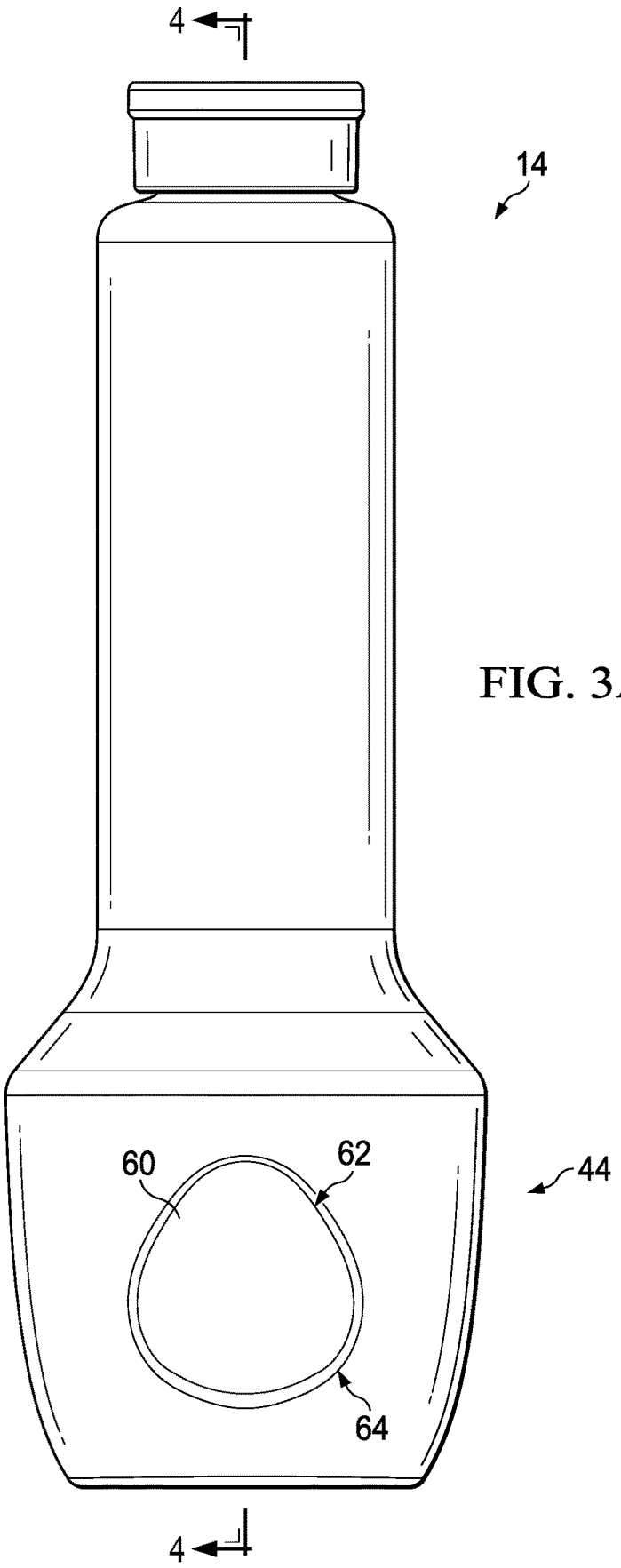
FIG. 3A is a rear view of a personal care bottle
Figure 3B:
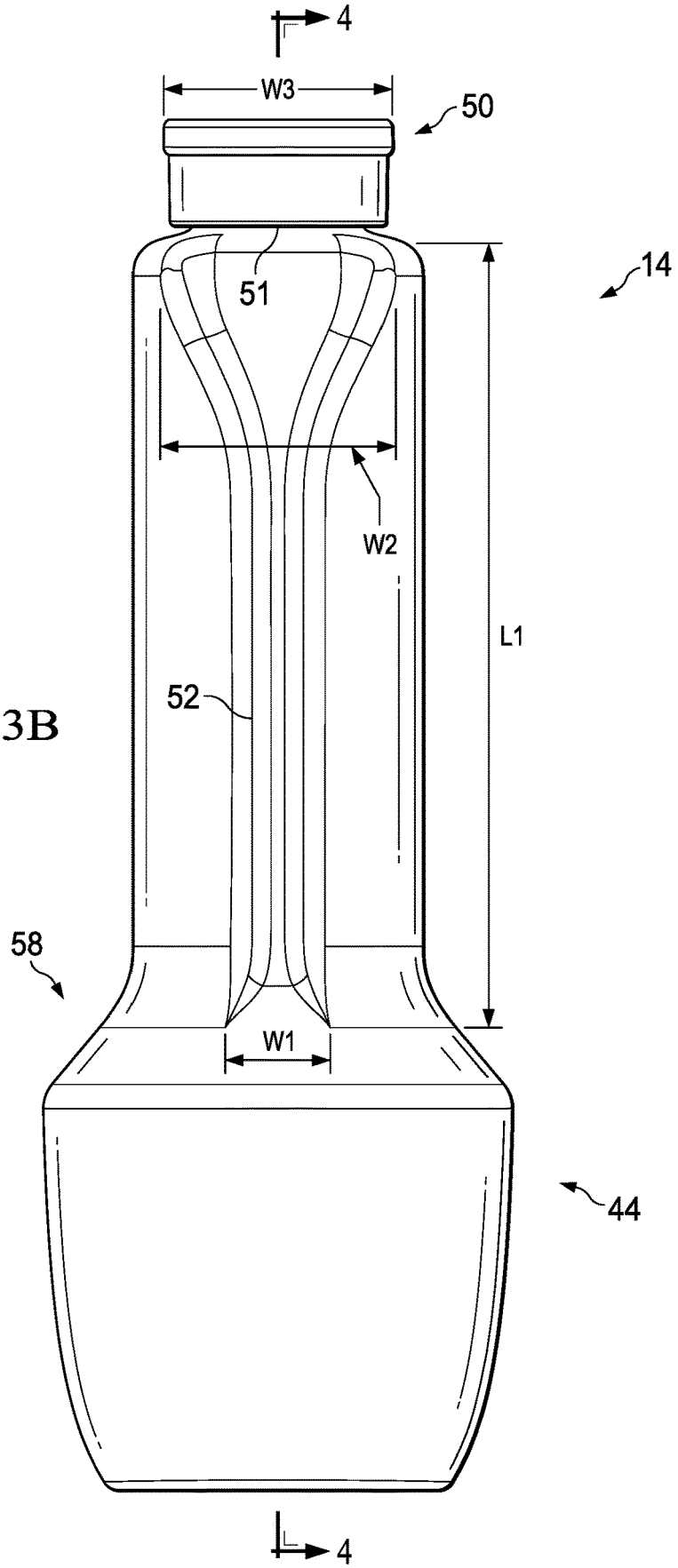
FIG. 3B is a front view of the personal care bottle of FIG. 3A

Referring to FIGS. 3A and 3B, a rear view and a front view of the personal care bottle 14 are illustrated, respectively. The distal end portion 44 of the personal care bottle 14 may have a recessed surface 60 (FIG. 3A) positioned on an opposite side of the personal care bottle 14 from the groove 52 (FIG. 3B). The recessed surface 60 may be dimensioned to receive a digit of a consumer (e.g., thumb) to aid in gripping and inserting the personal care bottle 14. The recessed surface 60 may have a smaller width toward a proximal end 62 of the recess 60 that increases toward a larger width toward a distal end of the recess 64 to better accommodate the shape of a consumer's thumb to facilitate loading and removal of the personal care bottle 14.

Referring to FIG. 3B, the groove 52 may have a length "L1" that is at least 10% of the overall length of the personal care bottle 14. The groove 52 may extend from the cap 50 (e.g., distal end 51 of cap 50) toward the distal end portion 44. In certain embodiments, the groove 52 may extend between the cap 50 and the shoulder 58. The groove 52 may have a width "w1" of about 2 mm to about 4 mm toward the distal end portion 44 and a width "w2" of about 4 mm to about 13 mm toward the cap 50. In certain embodiments, the width "w2" may be greater than or equal to a width "w3" of the cap 50 where the cap 50 meets the shoulder 42, which may provide a visual indication for proper insertion of the personal care bottle 14 and facilitate guiding the protrusion 56 (FIG. 2) into the smaller width "w1" of the groove 52. In certain embodiments, w2 may be three times greater than w1.

Figure 4:
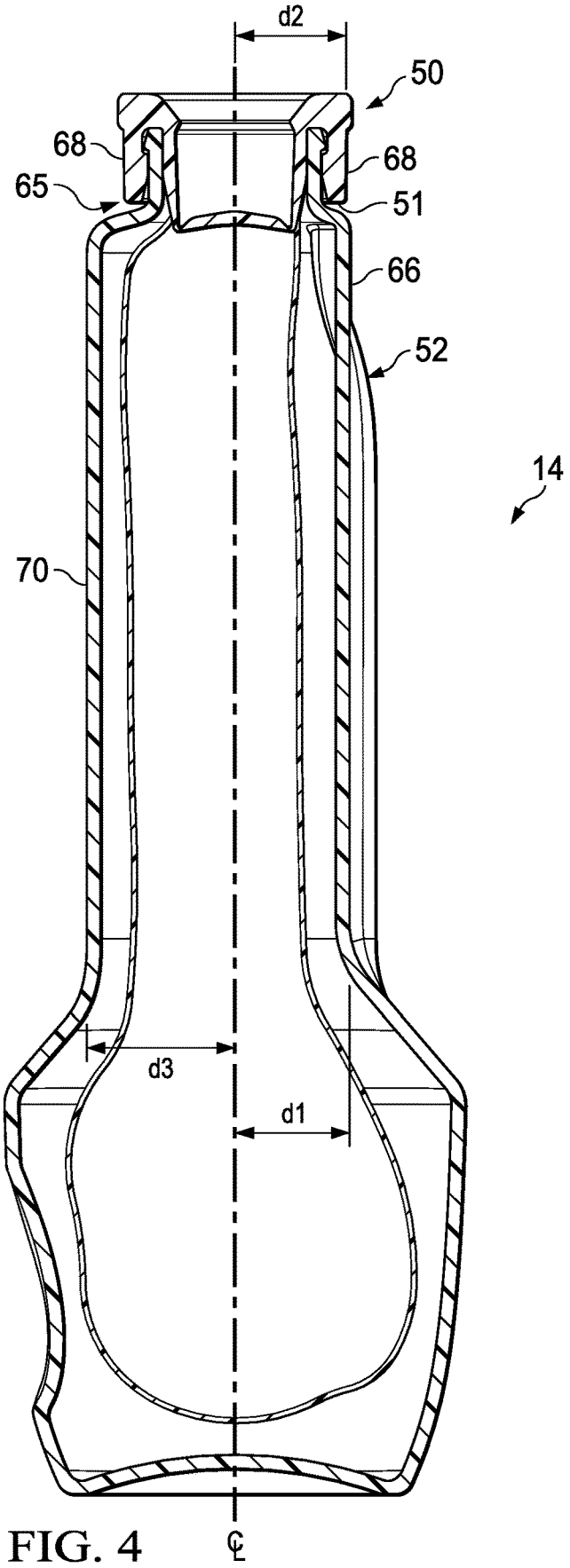
FIG. 4 is a cross section of the personal care bottle, taken generally along the line 4-4 of FIG. 3B.
Figure 5:
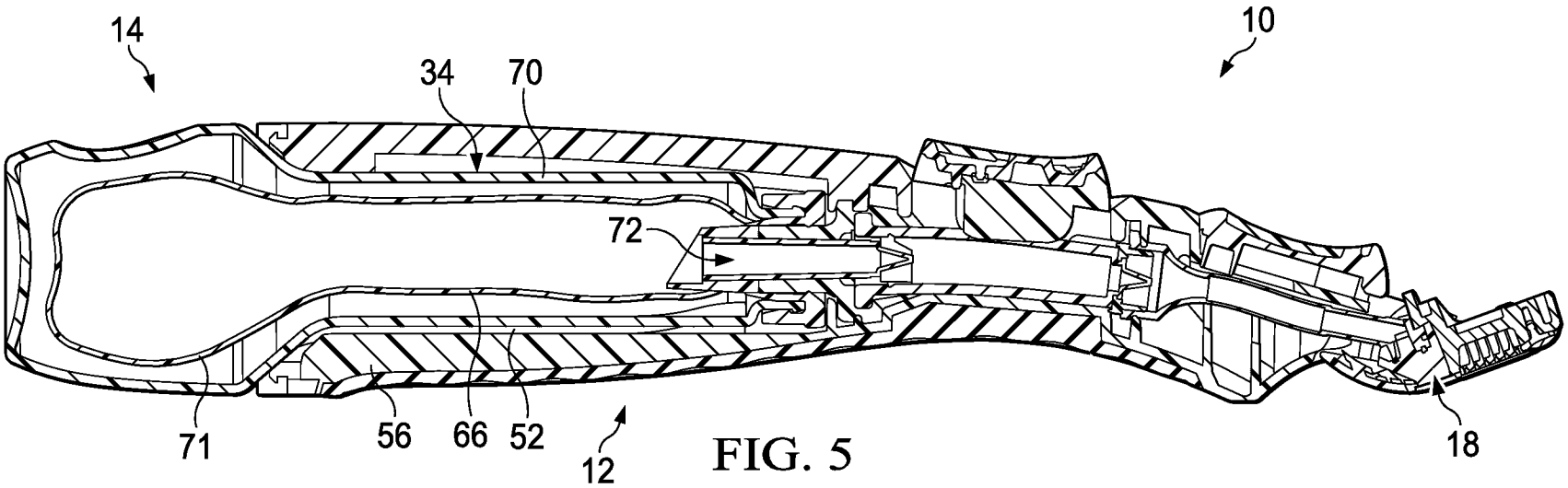
FIG. 5 is a cross section of the liquid dispensing shaving razor, taken generally along the line 5-5 of FIG. 1.

Referring to FIG. 4, a cross section view of the bottle 14 is illustrated, taken generally along the line 4-4 of FIG. 3B. In certain embodiments, a distance "d1" from a centerline "CL" of the bottle 14 to an outer surface 66 of the personal care bottle 14 defining the groove 52 (i.e., bottom surface of the groove 52) may be about 6.0 mm to about 8.0 mm A distance "d2" from the centerline "CL" to an outer surface 68 of a distal end portion 65 of the cap 50 (e.g., where the cap 50 meets the personal care bottle 14) may be less than or equal to the distance "d1" or the distance "d1" may be within (plus or minus) about 5% of the distance "d2". The outer surface 68 of the cap 50 may be generally aligned (e.g., walls may overlap) the groove 52 (e.g., the outer surface 66). The personal care bottle may 14 have a second outer surface 70 that is outboard (e.g., offset) from the outer surface 68 of the cap 50 (e.g., the outer surface 68 of the cap 50 may extend all the way around the cap 50). The outer surfaces 66 and 70 may be positioned within the opening 34 of the handle 12, as shown in FIG. 5. In certain embodiments, a distance "d3" from the centerline "CL" of the personal bottle 14 to the outer surface 70 of the personal care bottle 14 (e.g., on an opposite of the outer surface 66) that defines the groove 52 may be greater than d1. The distance d3 may be about 7.6 mm to about 9.6 mm. In certain embodiments, d3 may be equivalent to a radius of the personal care bottle 14 (e.g., for cylindrical shaped bottles). The dimensions d1 and d2 may prevent the cap 50 from interfering with the groove 52 during insertion and removal of the personal care bottle 14. As will be explained in greater detail below, the dimensions of the d1, L1 and d2 may also provide sufficient engagement between the groove 52 and the protrusion 56 to prevent twisting of the personal care bottle 14.

Referring to FIG. 5 a cross section view of the shaving razor system 10, taken generally along the line 5-5 of FIG. 1 is illustrated. In certain embodiments, a sealed collapsible bag 71 may be positioned within the personal care bottle 14. The collapsible bag 71 may be sealed prior to loading the personal care bottle 14 into the handle 12. The collapsible bag 71 may be configured to contain a liquid. The shaving razor system 10 may include a pump system 72 having at least a portion positioned within the personal care bottle 14 (e.g., extending within the collapsible bag 71) to facilitate the transfer of liquid from the personal care bottle 14, through the pump system 72 and to an outer surface of the shaving razor cartridge 18 (e.g., the ports 28 shown in FIG. 1). A tight seal may be formed between the pump system 72 and the personal care bottle 14 to prevent liquid from leaking into the handle 12. Rotational movement of the personal care bottle 14 may be transferred to the pump system 72, which may twist and damage the pump system 72. Accordingly, the groove 52 of the personal care bottle 14 and the protrusion 56 of the handle 12 may provide sufficient resistance against rotation of the personal care bottle 14, to prevent damage to the pump system 72 (twisting of flexible tubing for that transfers liquid).

Figure 6:
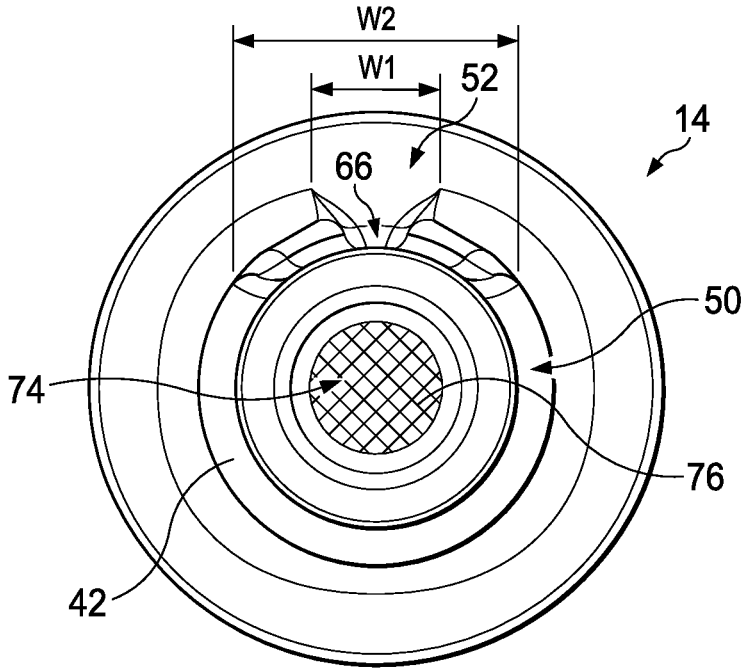
FIG. 6 is a top view of the personal care bottle of FIG. 3A.

Referring to FIG. 6, a top view of the personal care bottle 14 is illustrated. The cap 50 may be mounted to the proximal end 40 (FIG. 2) of the personal care bottle 14. The personal care bottle 14 may define an opening 74 having a frangible seal 76. The frangible seal 76 may provide an air tight seal until the frangible seal 76 is punctured by the pump system 72, as shown in FIG. 5. The groove 52 may originate at shoulder 42, (e.g., just below the cap 50). The width "w2" of the groove 52 toward the cap 50 may be greater than the width "w1" of the groove 52 that extends along a majority of a length of the personal care bottle 14 (see also FIG. 3B). In certain embodiments, the outer surface 66 of the groove 52 may be generally aligned with the outer surface 68 (FIG. 4) of the cap (e.g., such that the protrusion 56 of FIG. 2 is not prevented from aligning and sliding within the groove 52).

Figure 7:
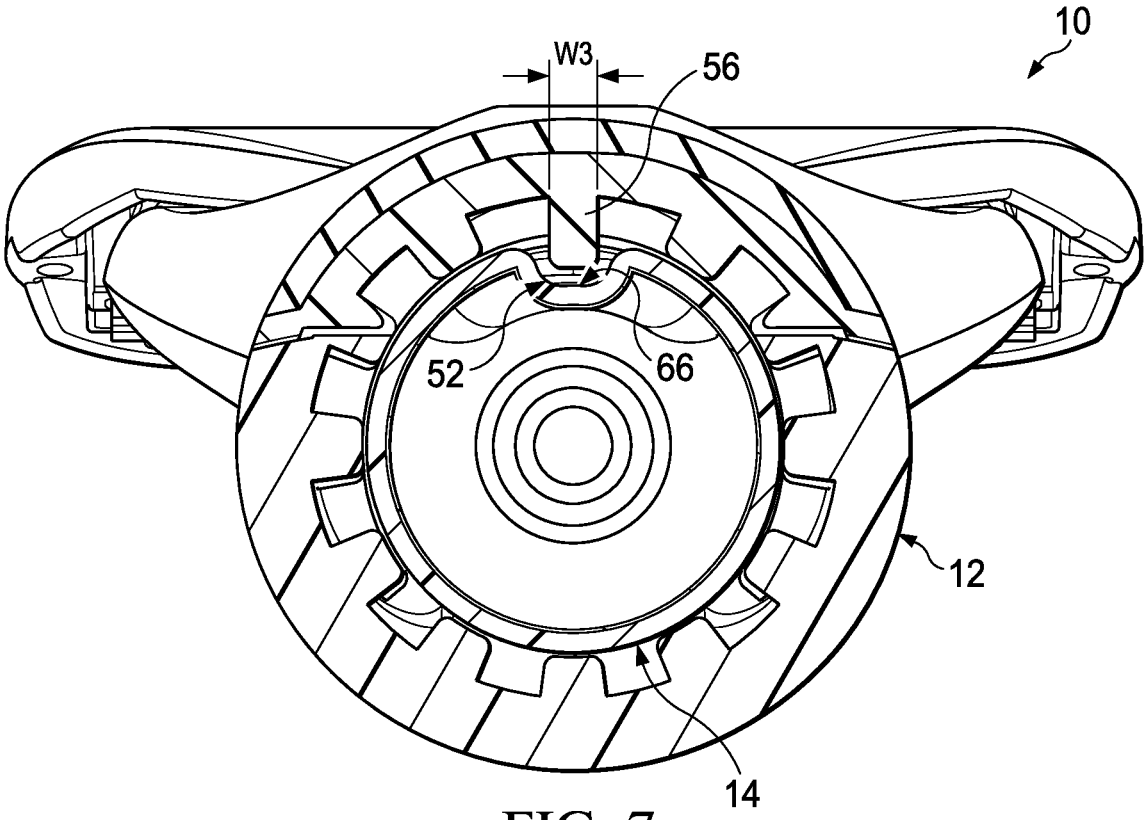
FIG. 7 is a cross section view of the liquid dispensing razor, taken generally along the line 7-7 of FIG. 1.

Referring to FIG. 7, a cross section view of the shaving razor system 10, taken generally along the line 7-7 of FIG. 1 is illustrated. The protrusion 56 of the handle 12 may be initially inserted into the area of the groove 52 having the width "w2" (as shown in FIGS. 3B and 6). The protrusion 56 may be spaced apart from the personal care bottle 14 (e.g., not touching the outer surface 66 of the groove 52) as it inserted into its final position to decrease the force required to insert the personal care bottle 14 into the handle 12. For example, the personal care bottle 14 may be difficult to insert if the protrusion 56 rides against the outer surface 66 of the groove 52. The protrusion 56 may have a width "w3" that is less than the width "w1" (FIG. 6). In certain embodiments, the width "w3" may be about 0.2 mm to about 1.0 mm to provide sufficient clearance to minimize binding, while also properly securing the personal care bottle 14. Accordingly, the width "w3" may be about 85% to about 95% of the width "w1" to provide sufficient resistance to prevent the personal care bottle 14 from twisting, while minimizing interference with surface 75 of the groove 52.

Figure 8:
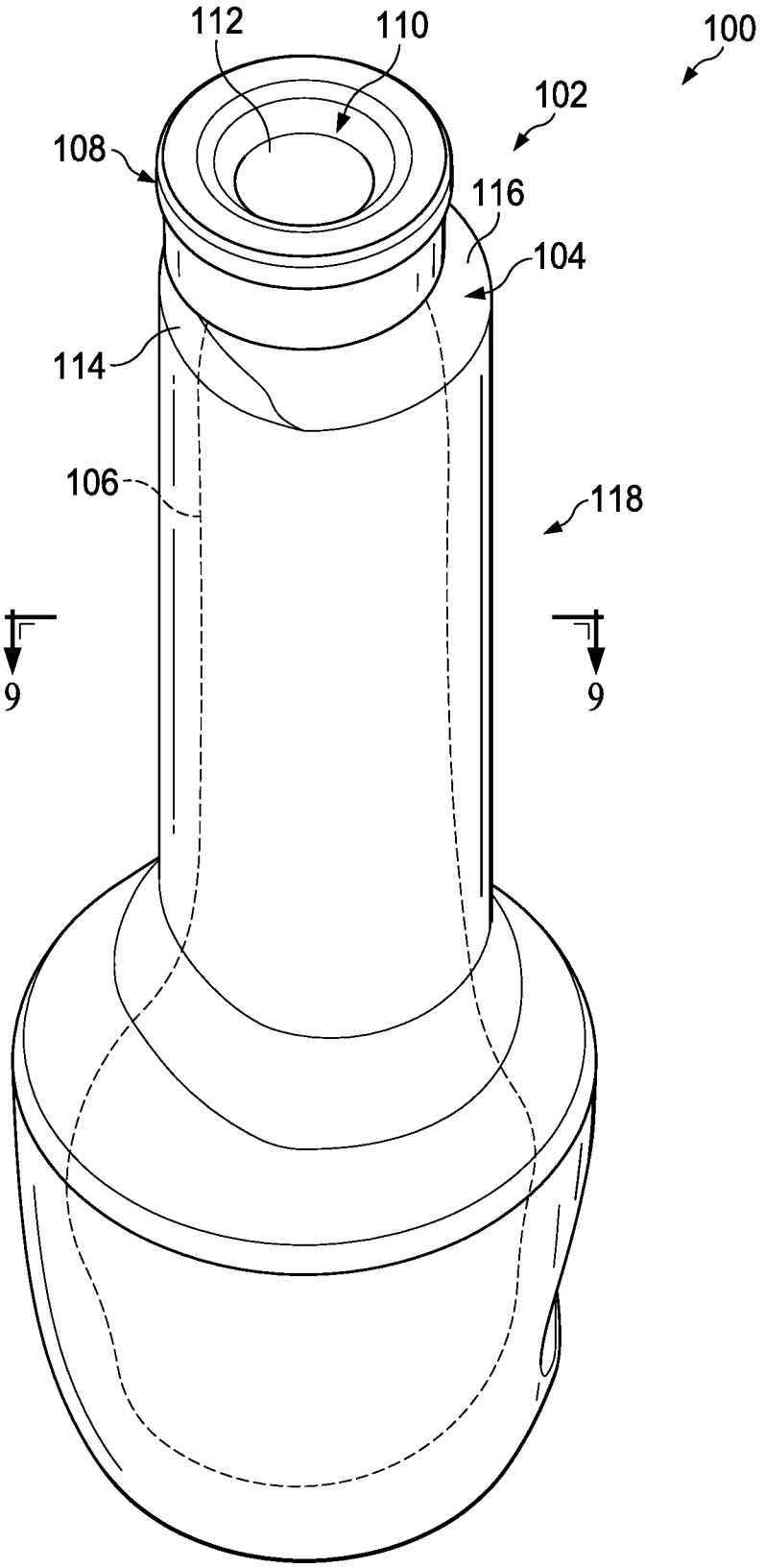
FIG. 8 is a perspective view of another possible embodiment of a personal care bottle.
Figure 9:
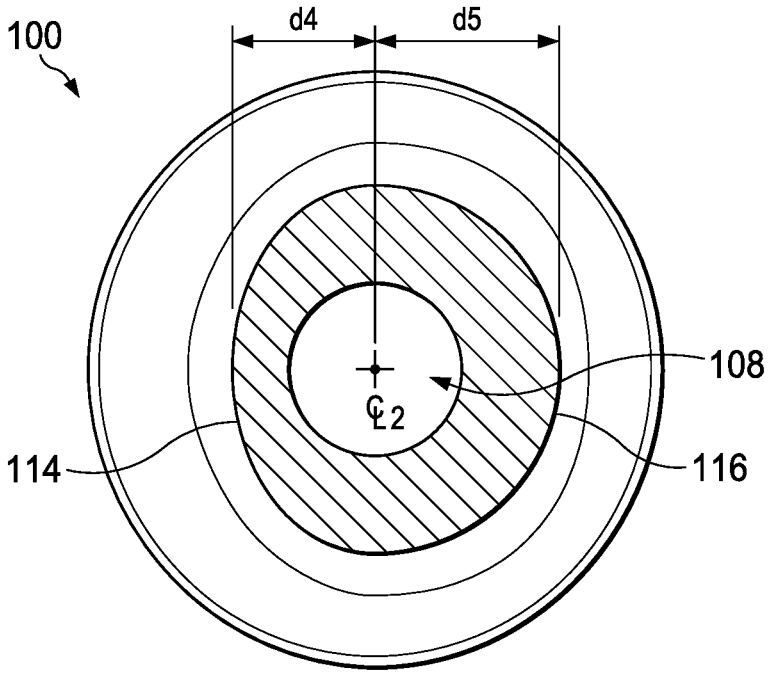
FIG. 9 is a cross section view, taken generally along the line 9-9 of FIG. 8.

Referring to FIGS. 8 and 9, another possible embodiment of a personal care bottle 100 is shown. The personal care bottle 100 may have a proximal end portion 102 with a shoulder 104 that extends partially around the personal care bottle 100. A collapsible bag 106 may be positioned within the personal care bottle 100 configured to contain a liquid, such as a moisturizer or shaving cream. A cap 108 mounted may be mounted to the proximal end 102 of the personal care bottle 100. The cap 108 may define an opening 110 having a frangible seal 112 to keep air out of the bag 106 prior to engaging with a pump system of a handle (as previously described), which may negatively impact the performance of the fluid contained within the bag 106. The personal care bottle 100 may have a first and second outer surfaces 114 and 116 where the personal care bottle meets the cap 108 (i.e., distal end of the cap).

Referring to FIG. 9, a cross section view of the personal care bottle 100, taken generally along the line 9-9 of FIG. 8 is illustrated. The cap 108 may have a centerline "CL2" (e.g., extending longitudinally through the personal care bottle 100). In certain embodiments, a horizontal distance "d4" from the centerline "CL2" to the first outer surface 114 (also shown in FIG. 8) of the personal care bottle 100 where the personal care bottle 100 meets the cap 108 is less than a horizontal distance "d5" from the centerline "CL2" to the second outer surface 116 (also shown in FIG. 8) where the personal care bottle 100 meets the cap 108. In certain embodiments, d4 may be about 6 mm to about 8 mm and d5 may be about 7.6 mm to about 9.6 mm. The first outer surface 114 and the second outer surface 116 may be on opposing sides of the personal care bottle 100. Accordingly, as shown in FIGS. 8 and 9, a proximal end portion of the personal care bottle 100 (i.e., the portion of the personal care bottle 100 that fits within a handle of a device) may be asymmetrical. For example, the upper half to upper two thirds of the personal care bottle 100 may have an asymmetrical cross section. The geometry of the personal care bottle 100 may provide for intuitive loading into a handle (e.g., as illustrated in FIGS. 2 and 5) as well as prevent rotation of the personal care bottle 100 relative to a handle (e.g., as previously illustrated for handle), which may damage any pump system that may be engaged with the personal care bottle 100.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:

a bottle having a proximal end with a shoulder, a distal end portion and an outer surface defining a groove extending from the shoulder toward the distal end portion;

a sealed collapsible bag positioned within the bottle, the bag configured to contain a liquid;

a cap mounted to the proximal end of the bottle, the cap defining an opening having a frangible seal, the cap has an outer wall that is generally aligned with a bottom surface of the groove; and a handle having an opening at a first end dimensioned to receive the bottle, wherein the handle has a protrusion positioned within the groove of the bottle.

2. The shaving razor system of claim 1 wherein the bottle comprises an enlarged end portion having a shoulder that is mounted to a rim on a distal end of the handle.

3. The shaving razor system of claim 1 wherein the groove has a depth of about 1.5 mm to about 2.5 mm and the bottle has a wall thickness of about 0.5 mm to about 1.5 mm.

4. The shaving razor system of claim 1 wherein the first end of the handle has a partially enclosed rim having an opening aligned with the protrusion.

* * * * *